US012208983B2

(12) United States Patent
Robadey

(10) Patent No.: US 12,208,983 B2
(45) Date of Patent: Jan. 28, 2025

(54) STACKING DEVICE AND TRANSPORT BLOCK FOR A STACKING DEVICE

(71) Applicant: BOBST MEX SA, Mex (CH)

(72) Inventor: Pierre Robadey, Lausanne (CH)

(73) Assignee: BOBST MEX SA, Mex (CH)

( * ) Notice: Subject to any disclaimer, the term of this patent is extended or adjusted under 35 U.S.C. 154(b) by 413 days.

(21) Appl. No.: 17/756,998

(22) PCT Filed: Dec. 10, 2020

(86) PCT No.: PCT/EP2020/085605
§ 371 (c)(1),
(2) Date: Jun. 7, 2022

(87) PCT Pub. No.: WO2021/116325
PCT Pub. Date: Jun. 17, 2021

(65) Prior Publication Data

US 2023/0009808 A1 Jan. 12, 2023

(30) Foreign Application Priority Data

Dec. 10, 2019 (EP) ..... 19020685

(51) Int. Cl.
*B65H 31/30* (2006.01)

(52) U.S. Cl.
CPC ..... *B65H 31/3063* (2013.01); *B65H 31/3081* (2013.01); *B65H 2301/42172* (2013.01); *B65H 2701/176* (2013.01)

(58) Field of Classification Search
CPC ..... B65G 1/0478; B65G 47/53; B65H 29/38; B65H 29/46; B65H 31/26; B65H 31/28; B65H 31/30; B65H 31/3081; B65H 31/3063; B65H 39/10; B65H 39/075; B65H 33/06; B65H 2301/42172
USPC ..... 198/370.07, 370.08; 270/58.01, 58.29
See application file for complete search history.

(56) References Cited

U.S. PATENT DOCUMENTS

| | | | | |
|---|---|---|---|---|
| 4,280,690 | A | 7/1981 | Hill | |
| 4,315,710 | A | 2/1982 | de Somer | |
| 12,054,348 | B2 * | 8/2024 | Robadey | B65H 39/06 |
| 2013/0248325 | A1 | 9/2013 | Michler et al. | |

FOREIGN PATENT DOCUMENTS

| | | | |
|---|---|---|---|
| CN | 102030198 | A | 4/2011 |
| CN | 103287877 | A | 9/2013 |
| CN | 103402899 | A | 11/2013 |

(Continued)

OTHER PUBLICATIONS

European Patent Office, International Search Report, PCT/EP2020/085605, Mar. 12, 2021, 4 pages, Europe.

*Primary Examiner* — Leslie A Nicholson, III
(74) *Attorney, Agent, or Firm* — Bookoff McAndrews, PLLC

(57) ABSTRACT

A stacking device for generating decks (10) of sheet elements (12) comprises a transport device with an upper side onto which sheet elements (12) are arranged on separate sheet sections (50). Each sheet section (50) is adapted to transport at least one sheet element (12). The upper side has a height offset between adjacent sheet sections (50). A displacement element shifts sheet elements (12) of one sheet section (50) onto an adjacent sheet section (50) in order to produce the deck (10) of sheet elements (12).

14 Claims, 6 Drawing Sheets

(56) References Cited

FOREIGN PATENT DOCUMENTS

| | | | |
|---|---|---|---|
| CN | 103848240 | A | 6/2014 |
| CN | 105383963 | A | 3/2016 |
| CN | 106054568 | A | 10/2016 |
| CN | 107207175 | A | 9/2017 |
| CN | 110049935 | A | 7/2019 |
| EP | 0093987 | A2 | 11/1983 |
| WO | 2021116294 | A1 | 6/2021 |

* cited by examiner

STACKING DEVICE AND TRANSPORT BLOCK FOR A STACKING DEVICE

CROSS-REFERENCE TO RELATED APPLICATION(S)

This patent application is a National Stage Application under of 35 U.S.C. § 371 of International Patent Application No. PCT/EP2020/085605, filed on Dec. 10, 2020, which claims priority to European Application No. 19020685.4, filed on Dec. 10, 2019, the entireties of which are incorporated herein by reference.

FIELD OF THE INVENTION

The present invention relates to a stacking device for generating decks of sheet elements of paper, cardboard or plastic. Furthermore, the invention relates to a transport block for a stacking device.

BACKGROUND

A converting machine can be used for producing individual sheet elements from a substrate in sheet or web form. In a related process, the substrate can be printed and die-cut to form individual printed sheet elements, each with a unique motif.

One example of such sheet elements is a set of playing cards, where each card defines a sheet element. After printing and die-cutting, the sheet elements are arranged in rows and columns and are to be stacked to form decks. In a conditioning section of the converting machine, these sheet elements may initially travel in the rows and columns and then overlap on top of each other to form the final complete set.

Document U.S. Pat. No. 4,315,710 discloses a stacking device for assembling cards into decks. Partial decks are deposited into small recipients having a geometry allowing moving fingers to move across the recipients and push one partial deck over the other to form a single deck.

Another example of a stacking device is disclosed in document EP0093987. The device is configured to transversely move adjacent cards so they become positioned on top of each other and to form a pile.

Document U.S. Pat. No. 4,280,690 discloses a device for collating a plurality of sheets. The device comprises a main transportation conveyor and a plurality of transverse feed means arranged at an angle with the main conveyor. The sheets from the transverse feed means intercept the conveyor at selected locations such that a stack of superposed sheets is created.

SUMMARY

It is an object of the present invention to provide a stacking device for generating decks of sheet elements which is able to reliably stack sheet elements at high speed without a risk of jams of the sheet elements.

The invention provides a stacking device for generating decks of sheet elements, the stacking device comprising a transport device with an upper side for transporting the sheet elements, the upper side having a plurality of sheet sections configured to receive sheet elements to be arranged thereon, the plurality of sheet sections being arranged in rows and columns, wherein rows are aligned in a transport direction of the stacking device, and columns perpendicular thereto in a stacking direction, and wherein the plurality of sheet sections of one column having comprise at least one first sheet section and at least one adjacent second sheet section arranged further downstream in the stacking direction, and wherein a height offset is provided in the stacking direction between the first sheet section and the second sheet section, said height offset allowing at least one sheet element on the first sheet section to be moved over and be positioned on top of an adjacent sheet element on the second sheet section, at least one displacement element driven to be moved transverse to the transport direction, along the sheet sections of a column, the displacement element engaging with the sheet sections of one column for shifting the at least one sheet element of a first sheet section onto the sheet element on the adjacent, second sheet section, and wherein a guide for the displacement elements is arranged above the sheet sections, the guide extending obliquely across the upper side of the transport device in the transport direction.

The guide can be inclined with respect to the transport direction. Hence, the guide extends across in an inclined manner as seen in a top view of the stacking device.

"Upstream" and "downstream" are used with respect to stacking direction S. "Rear" and "front" are used with respect to transport direction T.

Preferably, a plurality of sheet elements are located on the first sheet section and a plurality of sheet elements are located on the adjacent second sheet section, each plurality of sheet sections forming a partial deck, and wherein the displacement element is configured to shift the partial deck on the first sheet section onto the partial deck on the adjacent second sheet section.

The partial decks of one column may form a common deck. Hence the "common deck" is a complete set of sheet elements. Such a common deck may include all playing cards in one full deck.

A sheet element and the input of the stacking device may be already made of several sheets, for example forming a sub-deck of playing cards, which is called here a "sheet element" and which has a given sheet thickness. The height offset between the sheet sections must be at least as large, but preferably larger than the sheet thickness.

In order to guarantee stacking in a given sequence and in order to avoid suction tools for handling sheet elements for stacking purposes, the present invention uses a transport device with a specific, profiled upper side. The specific profile extending along the stacking direction allows to shift the sheet element positioned on a higher sheet section onto the adjacent sheet section having a lower sheet section. This shifting is achieved by a displacement element being moved across the upper side of the transport device. preferably the profiled upper side of transport device is the same across rows which facilitates production of the profile of the upper side.

Stop protrusions can be provided to define the front ends of the sheet sections. This allows to perfectly align the sheet elements which contact the stop protrusions with their front edge. Stop protrusions are preferable perpendicular to the surface of the upper sheet section that is in contact with the lowermost sheet element.

Preferably, the sheet sections are sloped in the stacking direction. The slope may be upwardly sloped in the stacking direction. This ensures an uninterrupted contact of the sheet stacks with the ends of the sheet section during the shift along the stacking direction, so they are not rotated during their sideward shift movement. Preferably, the slope may be between 2% and 10%, for example 5%, with respect to the horizontal. The front end of each sheet section being lower than its rear end. The tilting is particularly suited when a single displacement element of cylindrical shape is used to shift the sheet stacks sideward.

The stop protrusion or stop protrusions of one column may be extending or provided in a linear arrangement. This ensures a guiding of the sheet elements stacks during the shift along the stacking direction.

The stop protrusion or protrusions can be integrally connected to the part defining the upper side of the transport device or can be a separate part attached to the part defining the upper side of the transport device.

At least one displacement element can be associated with each column, i.e. the at least one displacement element shifts the sheet elements of one column onto each other.

In an embodiment, the guide can be a linear guide and can extend in an angular range of 10-80°, more specifically in a range of 30-70° with respect to the transport direction.

In an embodiment, the guide forms part of an endless, loop track. This provides a reliable mechanism for the drive of the displacement elements. Within this track, a driven push or pull means like a belt, chain or cable can be located. Displacement elements are attached to the push or pull means.

The track can have a triangular shape with rounded corners, wherein one side (the guide) extends across the upper side of the transport device inclined to the transport direction. The other sides can extend perpendicular to the end in transport direction.

The displacement element or elements preferably extend from above to a position below the sheet sections. In such a way, any gap can be avoided between the upper side of the sheet sections and the lower end of the displacement elements.

The sheet sections may comprise at least one lateral groove into which the displacement element protrudes. This helps to avoid the above-mentioned gap. The lateral groove can extend along the stacking direction. The stacking direction is preferably perpendicular to the transport direction.

In an embodiment, at least two displacement elements can be provided for each column. Each of the displacement elements can have a single, associated groove in the sheet sections of a column. This has an effect of contacting the sheet elements safely so they are not rotated during their sideward shift movement. As an alternative to the two displacement elements, a single displacement wide element with a width of at least 25% of the sheet length can be provided.

The displacement elements of each column can be affixed to a common carrier guided by the guide. This ensures a sufficient stability of the displacement elements.

The transport velocity of the sheet sections in transport direction corresponds to the velocity (more precisely to the components of the velocity) of the displacement element in the transport direction. This ensures that the relative movement between the displacement element or elements and the sheet elements is a pure lateral movement directed perpendicular to the transport direction.

The transport device can be an endless track forming a loop. This endless track can be formed e.g. by an endless belt, an endless chain or an endless cable or a plurality of these elements, driven by driving and deflecting rollers.

Profiled transport blocks define the upper side of the transport device. These profiled transport blocks are attached to each other.

According to one embodiment, an endless, flexible push or pull element, e.g. an endless belt, chain or cable is provided, and the transport blocks are attached to the corresponding endless push or pull element.

According to another embodiment, the transport blocks are immediately attached to each other by a rotational axis in order to define an endless chain.

It is advantageous that the transport blocks are not rigidly connected to each other as they have to move or swivel downwardly at the end of the upper side of the transport device when reaching the final deflecting or driving roller. In this manner the transport block after having released its sheet elements can be moved underneath the table-like upper side. It is then moved in the counter-transport direction towards the deflecting roller at the front end of the transport device where it is moved upwardly to define part of the upper side again.

A dispatching device, i.e. an endless belt, is arranged adjacent to the edge of the transport device associated to the lowermost row of sheet sections. The displacement elements are arranged so as to shift the decks onto the adjacent dispatching device which removes the decks from the stacking device.

The present invention also provides a transport block for the stacking device according to the invention. The transport block has a profiled upper side and an opposite lower side. The upper side has a plurality of sheet sections configured to receive sheet elements to be arranged thereon, and wherein a height offset is provided in the stacking direction between adjacent sheet sections.

The transport block has a front and rear end, the front end comprising a stop protrusion protruding above the sheet sections and/or the transport block has at least one groove at its upper side extending parallel to the front end.

The transport block can be molded from plastic material.

BRIEF DESCRIPTION OF THE DRAWINGS

In the accompanying drawings

DETAILED DESCRIPTION

Figure 1:
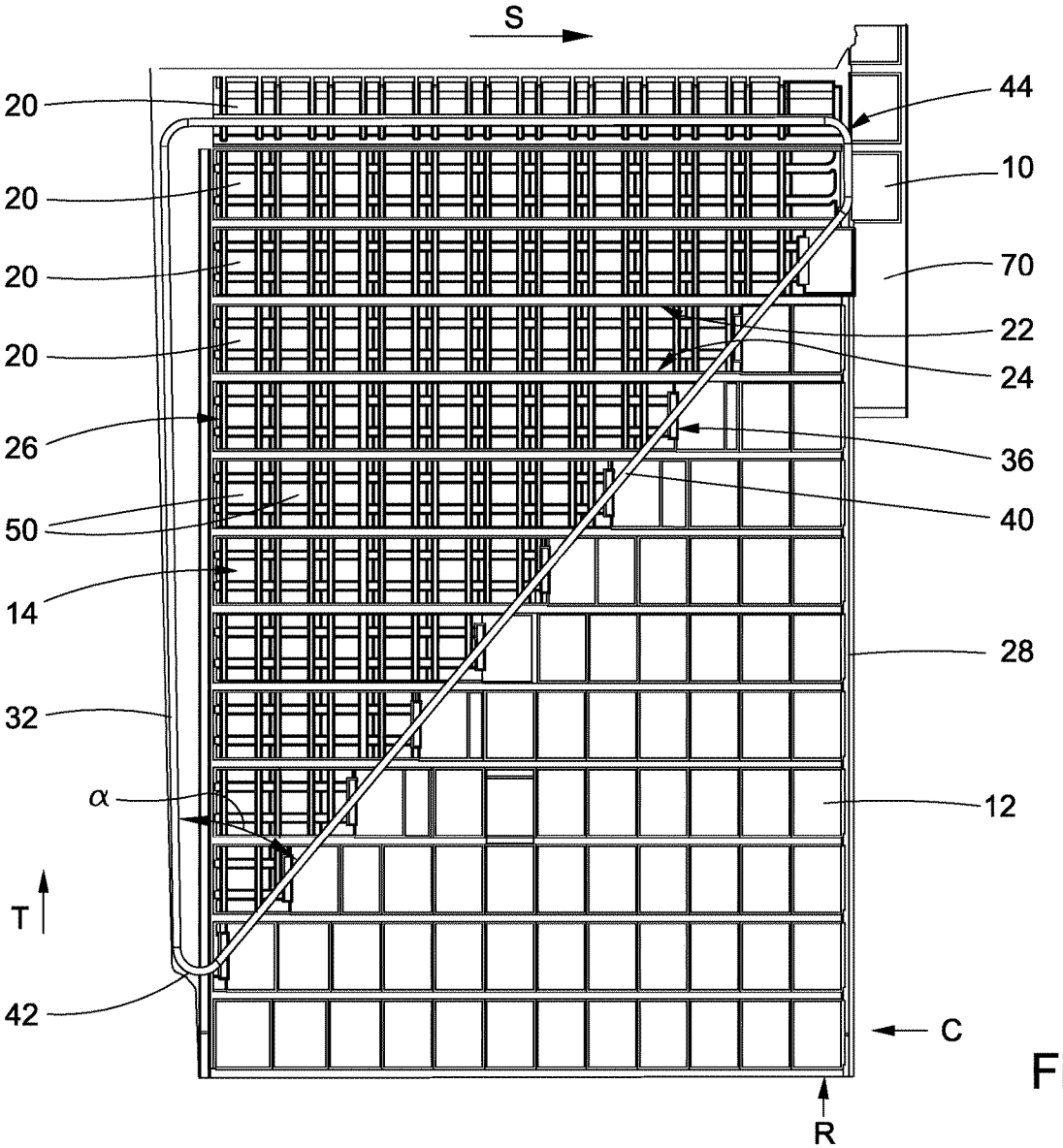
FIG. 1 shows an upper top view of an embodiment of the stacking device according to the present invention.

In FIG. 1, a stacking device for generating decks 10 of sheet elements 12 made of paper, cardboard (including corrugated board) or plastic is shown.

The stacking device comprises a transport device 14 which is an endless track comprising a push or pull means as an endless belt 16 (see FIG. 4) which is driven by one or more rollers 18 and is partly wound around deflecting rollers.

Instead of an endless belt 16, a chain or one or more endless cables can be provided. Thus, whenever the term "endless belt" is used in the following, chains, cables etc. can be used instead of an endless belt 16.

Figure 4:
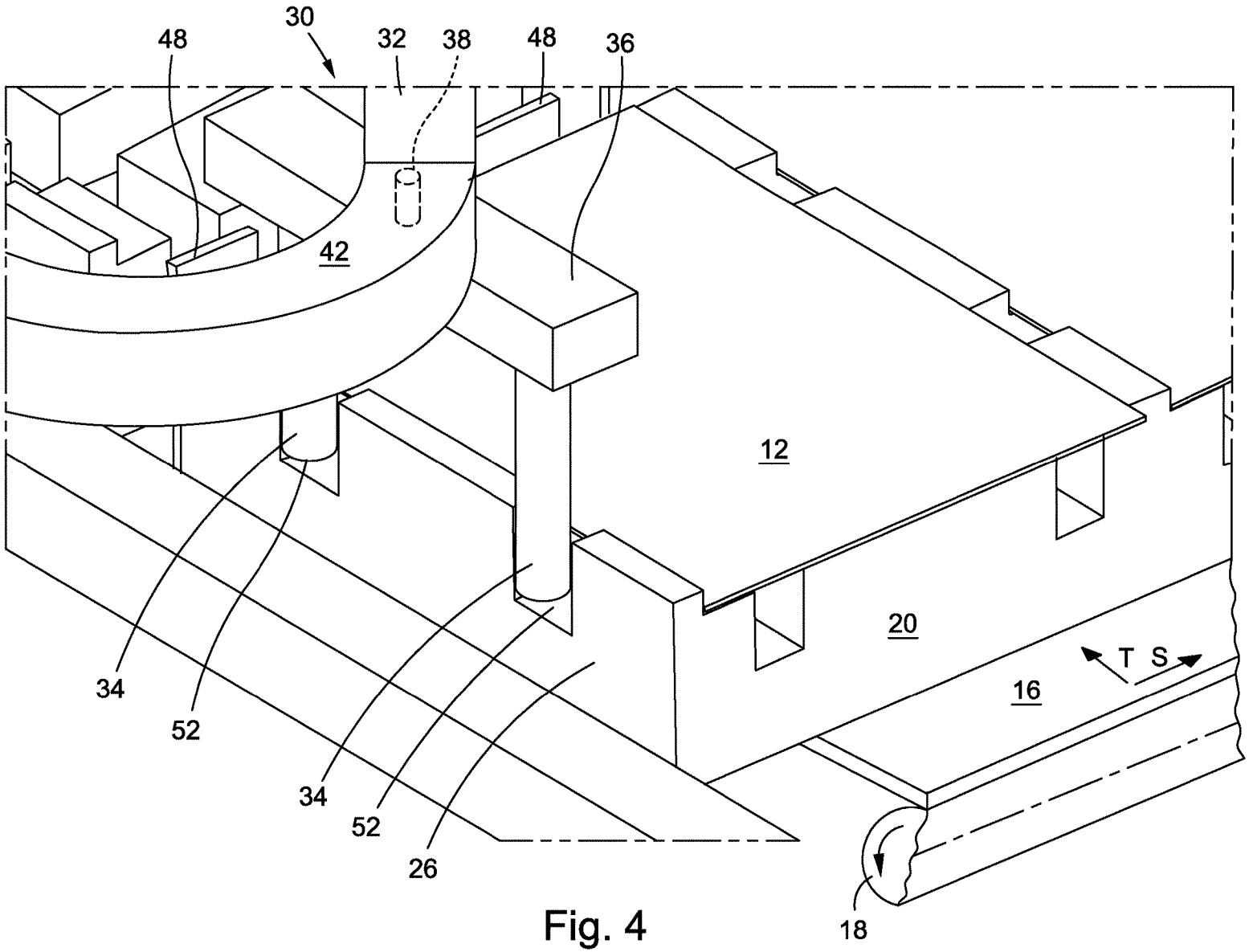
FIG. 4 shows a detail of the stacking device of FIG. 1 at the beginning of the stacking process.

Several elongate transport blocks 20 are attached to the outer side of the endless belt 16 (see FIGS. 1 and 4).

The endless belt 16 is driven in a transport direction T (see FIGS. 1 and 4).

The transport blocks 20 may be arranged with their longer side coinciding with the transport direction T. Alternatively, in a non-illustrated embodiment, the longer side of the transport blocks may be aligned perpendicular to the transport direction T.

Each transport block 20 has a front end 22 and a rear end 24 which are parallel to each other and to the stacking direction S and perpendicular to transport direction T.

Furthermore, each transport block 20 has a first longitudinal edge 26 upstream (here the left hand edge seen in transport direction T) and an opposite edge 28. The edges 26 and 28 of all blocks 20 define the longitudinal edges of the transport device.

A displacement device 30 is arranged above the upper side of the transport device. The "upper side" is defined by all transport blocks 20 protruding upwardly from the endless belt 16, i.e. having their upper side being directed upwardly. As endless belt 16 is been moved together with its transport blocks 20 some transport blocks 20 are facing downwardly and some upwardly.

Figure 2:
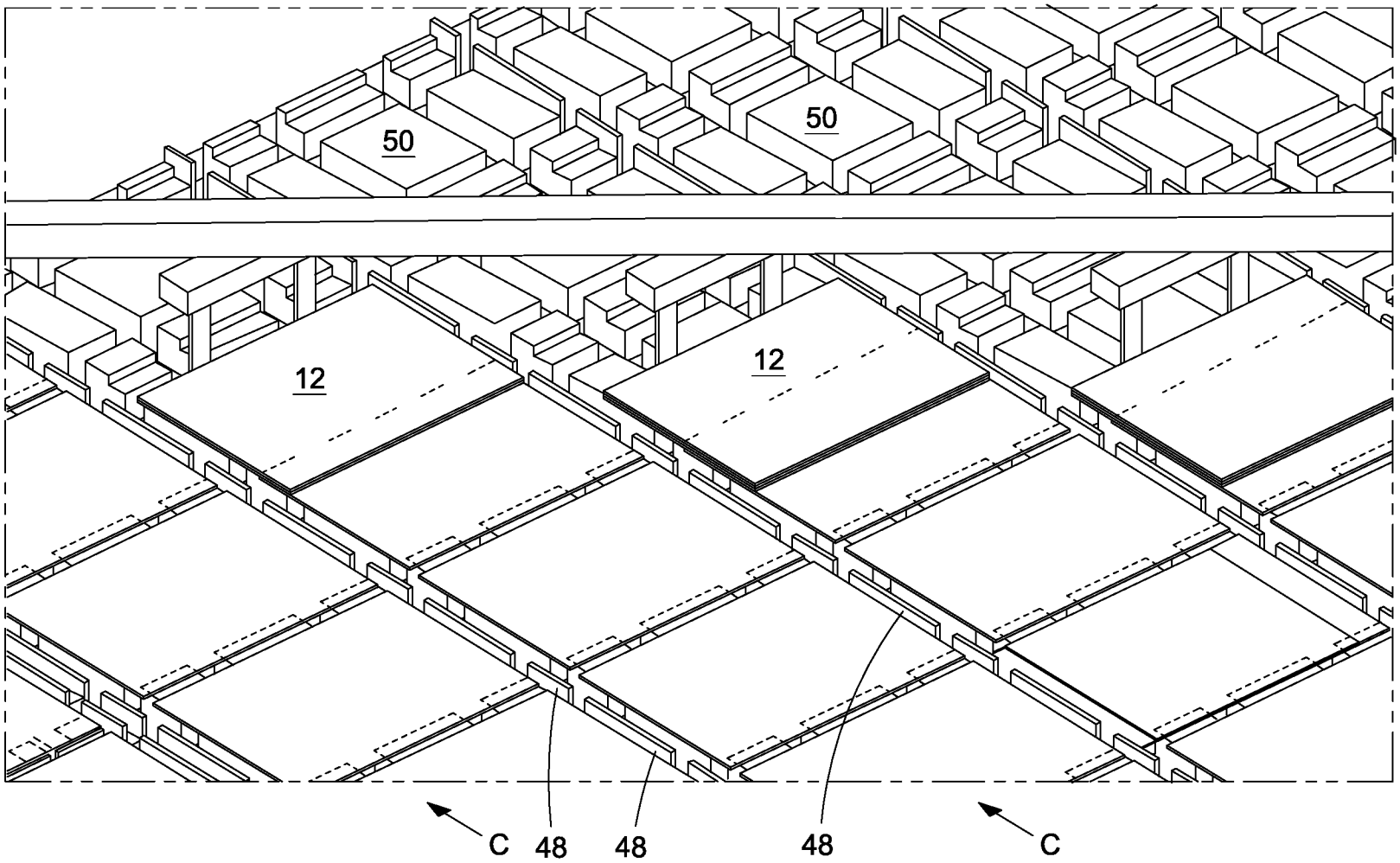
FIG. 2 shows a perspective view of a part of the upper side of the stacking device according to FIG. 1.
Figure 3:
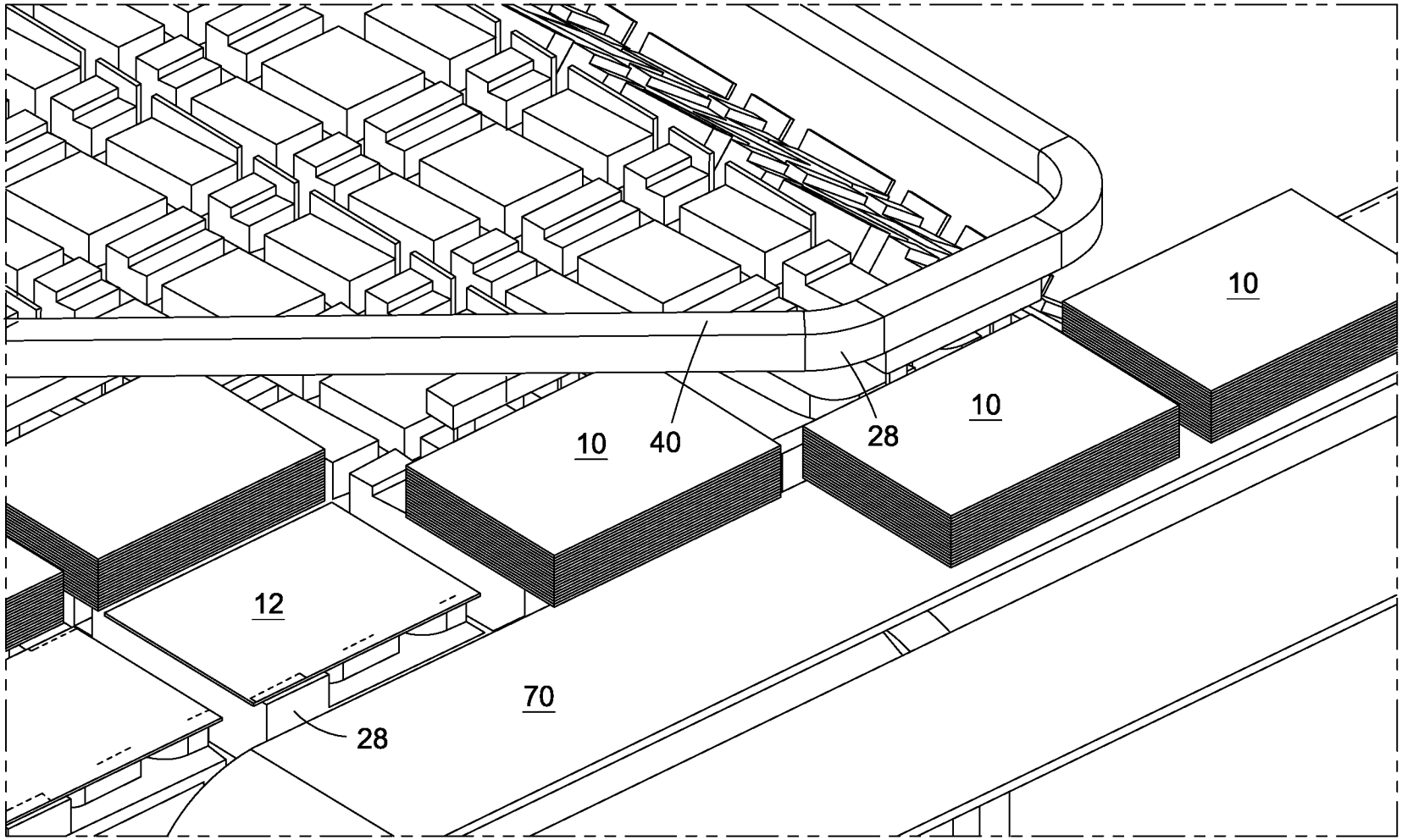
FIG. 3 shows a perspective view of the upper side of the stacking device according to FIG. 1 at the end of the stacking process.

Displacement device 30 comprises an endless, loop track 32 which guides and drives displacement elements 34 (see FIGS. 2 to 4).

In an embodiment, one single displacement element 34 is attached to a carrier 36, or directly to an endless push or pull element 110, e.g. a chain, endless belt or cable which is moved along track 32. The displacement element 34 is placed preferably in the middle of each sheet element longitudinal side, so that the sheet element is not rotated during its sideward shift movement. This embodiment allows the carrier 36 to freely rotate around the vertical axis, resulting in a simpler system. In another embodiment, two displacement elements 34 are attached to a carrier 36 in order to form a fork-like body. Carrier 36 has a pin 38 (see FIG. 4) which protrudes into track 32 in which an endless push or pull element, e.g. a chain, endless belt or cable is moved. Pin 38 is coupled to sliders within guide track 32 which are attached to the push or pull element. As a drive for moving the endless push or pull element a motor with a gear or friction roller engaging the push or pull element can be used. In this embodiment, the orientation of the carrier 36 along the vertical axis must be fixed, thus the guide 40 must be arranged to control the orientation of carrier 36.

Figure 6:
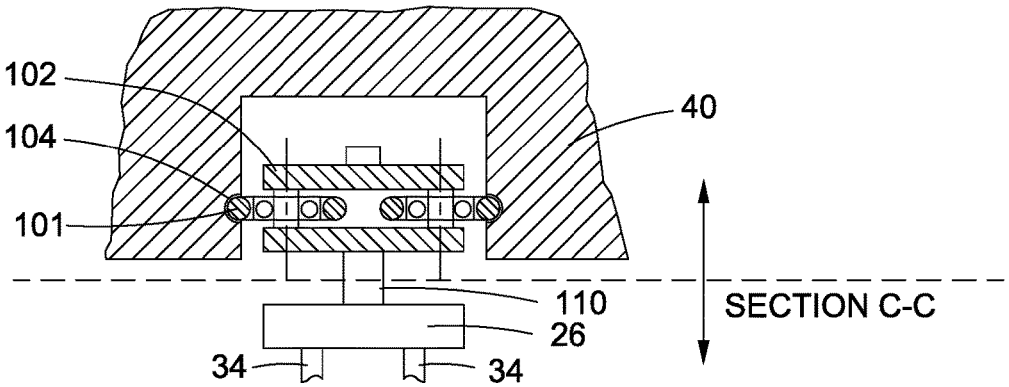
FIG. 6 shows an example of guide that controls the orientation of the carrier according to the present invention.
Figure 6:
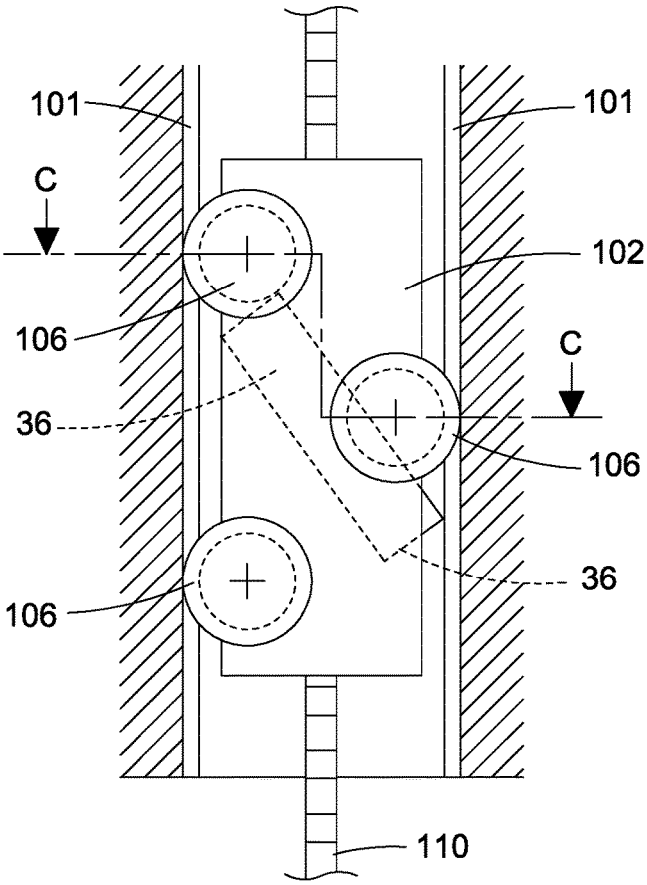
Figure 7:
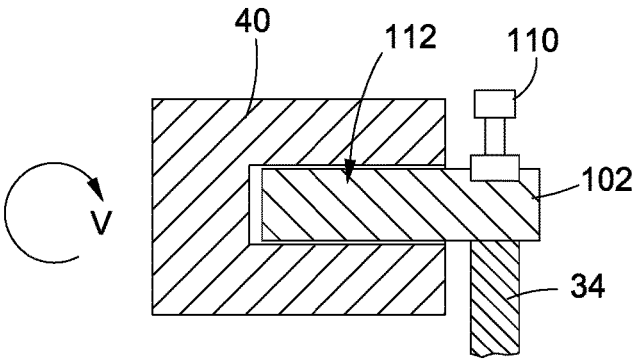
FIG. 7 shows an example of guide that does not control the orientation of the carrier according to the present invention.

Linear guides that are arranged to control the orientation of the guided element, or that let the orientation of the guided element free are well known in the art. FIG. 6 shows an example of a guide 40 that controls the orientation of the carrier 36, whereas FIG. 7 shows an example of a guide where the orientation of the carrier is not well controlled, but which is simpler to implement.

FIG. 6 shows a guide 40 with two inner grooves 101. A guided carrier 102 comprising three wheels with ball bearings and with an outer profile 104 adapted to engage into groove 32. When engaged into the groove 101 with its three wheels 106, the guided carrier 102 has a single degree of freedom, resulting in the control of the orientation of the displacement element(s) 34 attached below. The guided carrier 102 is connected to and transported by an endless push or pull element 110, e.g. a chain, endless belt or cable, which moves the guided carrier along guide 40. The endless push or pull element car be placed in-between the guided carrier 102 and the displacement element(s) 34, as shown in FIG. 6, or above the guided carrier 102. FIG. 7 shows a guide 40 with a groove 112 in which a guided carrier 102 engages. The engagement of the guided carrier 102 into the groove 112 fixes the orientation along direction V of the displacement element 34, to ensure a proper alignment of the stacks of sheet elements along stacking direction S. The guided carrier 102 is transported by an endless push or pull element 110, e.g. a chain, endless belt or cable, along guide 40.

Track 32 has a triangular shape with two sides arranged perpendicular to each other. The first side extends parallel to transport direction T and the second side perpendicular thereto. A third side which is termed "guide" 40 extends at an angle across the upper side (see FIG. 1).

Guide 40 may extend at an angle $\alpha$ of 10-80°, more particular 30-70° with respect to the transport direction T, across the upper side of the transport device (see FIG. 1).

Guide 40 extends linearly from an rear end 42 at the left hand side longitudinal edge to a front end 44 at the right hand side longitudinal edge.

As can be seen from FIGS. 1, 2 and 3, carriers 36 are aligned in different angles with respect to the portion of the track 32 at which they are positioned. Along guide 40, carriers 36 are arranged inclined to longitudinal direction T of guide 40, whereas in the remainder of track 32 carriers 36 are arranged in track direction. Deflector elements or drive elements are provided to align carriers 36 correspondingly.

As can be seen from FIG. 1, numerous sheet elements 12 are distributed over the upper side of the transport device in rows R (aligned in transport direction T) and columns C (aligned in stacking direction S). The plurality of transport blocks 20 (see FIG. 4) are defined by the rows R and columns C and provide sheet sections 50 on which the sheet elements 12 lie. In an embodiment, each transport block 20 may initially receive one sheet element 12. However, in a preferred embodiment, each transport block 20 is configured to receive a plurality of superposed sheet elements 12 in the form of partial decks. In such a way, the present stacking device can stack a plurality of partial decks on top of each other and quickly form a larger complete deck 10.

As the present stacking device may comprise several columns C, each column C is preferably associated with at least one displacement element 34 (as described above). The displacement elements 34 are travelling along the endless loop track 32 and numerous displacement elements 34 can be distributed along the endless loop track 32. The displacement elements 34 are preferably evenly distributed at a constant distance from each other along the endless loop track 32. This ensures that there is a constant supply of displacement elements 34 in order to continuously engage with the sheet sections 50 in the columns C. Hence, this allows some displacement elements 34 to be in operation (i.e. moving in the columns), while others are positioned on a return path of the endless loop track 32.

A device and method for creating such partial decks is described in the application PCT/EP2020/085546, which is hereby incorporated in its entirety into this application. The device in PCT/EP2020/085546 is an upstream-located stacking device which is designed to gradually overlap, in the transport direction T, individual sheet elements 12 in several transportation paths (i.e. rows R) on top of each other in order to form partial decks.

In such a way, the stacking device of the present disclosure can be used further downstream of the device in PCT/EP2020/085546 to superpose the partial decks from each column C, in a direction perpendicular to the transport direction T, such that a complete deck is created.

At the rear end, before reaching guide 40, sheet elements 12 are arranged one by one next to each other and distanced from each other. Therefore, each sheet element 12 has a specific row and a specific column position.

While being transported on the upper side of the transport device in transport direction T and as soon as the upstream side sheet elements 12 have reached guide 40, the sheet elements 12 of a column C are displaced beginning from the sheet element 12 on the upstream side, i.e. from the longitudinal edge at the left hand side in the figures, continuously towards the opposite longitudinal edge on the downstream side, i.e. a longitudinal edge on the right hand side in the figures.

Displacement of sheet elements 12 from upstream to downstream is achieved by displacement elements 34 engaging the upstream edge of the upstream side of sheet element 12 as can be seen in FIG. 4. Each pair of displacement elements 34 is associated to the column C at which it starts to contact a sheet element 12.

FIG. 1 shows that carriers 36 move together with their columns C of sheet elements 12 in transport direction. Carriers 36 are both moving in transport direction T and transversely thereto in stacking direction. The velocity of their movement in transport direction T corresponds to the velocity of the transport device.

As can be seen from FIGS. 1 to 4, sheet elements 12 of one column C are shifted to edge 28 when being moved in transport direction T by corresponding displacement elements 34. Partial decks formed on one of the sheet sections 50 are shifted onto the sheet element adjacent thereto so that the height of the deck is permanently increasing until all sheet elements 12 of one column C are stacked together.

At the end 28 of guide 40 the displacement elements 34 shift the decks 10 onto a dispatching device 70 in the form of an endless belt. The upper side of the dispatching device 70 is arranged slightly underneath the lowermost sheet section 50 which defines edge 28.

FIG. 1 further shows that each transport block 20 is associated to one, preferably one single column C. Thus, sheet elements 12 of one column C are positioned on the upper side of one transport block 20.

In order to perfectly align sheet elements 12 of one column C in transport direction T, each transport block 20 has at least one associated stop protrusion 48 at its front end. FIG. 2 shows that the stop protrusions 48 are protruding over the upper side of the transport device and that the stop protrusions 48 of one column C are arranged in a linear line. Transport blocks 20 are, for example, molded plastic parts.

Stop protrusions 48 can be integrally formed to transport blocks 20 or be defined by a separate plate-like part attached to the front side of transport block 20 (see FIG. 4).

Figure 5:
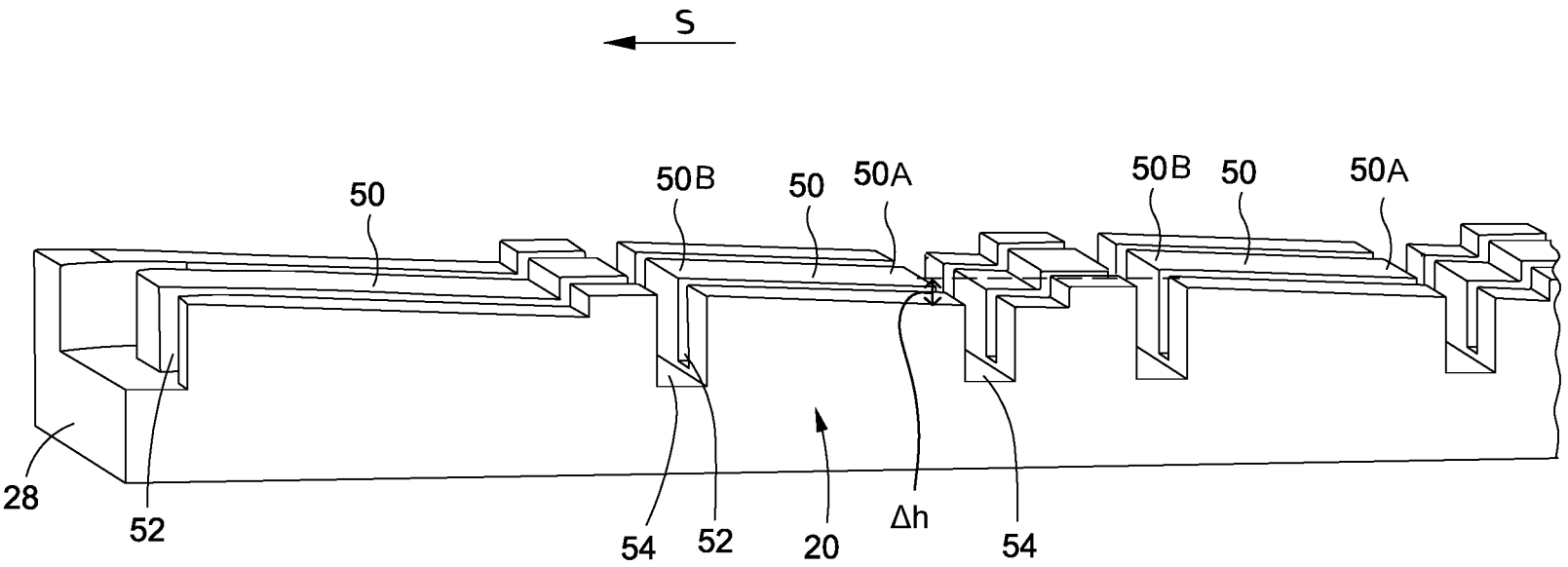
FIG. 5 shows a transport block according to an embodiment of the invention of the stacking device according to FIG. 1.

As can be seen from FIG. 5, each sheet section 50 is arranged with a height offset Δh in relation to an adjacent sheet section 50 in the stacking direction S. By travelling from upstream to downstream in the stacking direction S, every sheet section 50 exhibits a height offset Δh with its adjacent sheet section 50. This height offset must be at least as large, but preferably larger than the sheet element thickness, in order to ensure a proper stacking of the sheet elements. In a given column C, the sheet section which is the most upstream is also referred to as the "highest" sheet section, or the sheet section at the "upper side", the one which is the most downstream is referred to as the "lowermost" sheet section, even if their respective height compared to the horizontal might be the same. This height offset Δh allows the sheet elements are shifted onto each other (as can be seen in FIG. 2).

The sheet sections 50 of one column C have a first longitudinal edge 50A and a second longitudinal edge 50B. The second longitudinal edge 50B is located further downstream in the stacking direction S than the first longitudinal edge 50A. The second longitudinal edge 50B of the first sheet section 50 is located at a higher vertical position than the first longitudinal edge 50A of an adjacent second sheet section 50, arranged further downstream in the stacking direction S. This provides a height offset Δh in the stacking direction S between the adjacent sheet sections 50. The first longitudinal edge 50A and the second longitudinal edge 50B can be aligned with the respective edges of the sheet elements 12.

In order to avoid a gap between the upper side of the transport device and the lowermost end of displacement elements 34, even at the lowermost sheet section 50, displacement elements 34 extend into an associated lateral groove 52 in its transport block 20. Lateral grooves 52 extend along the full width of its transport block 20 so that displacement elements 34 can enter the lateral grooves at edge 26 and exit therefrom at edge 28.

Longitudinal grooves 54 in the transport block 20 allow plate-like guides to extend in-between the rows R of sheet elements 12 in order to ensure that the sheet elements 12 are positioned correctly on the sheet sections 50.

The invention claimed is:

1. A stacking device for generating a deck of sheet elements, the stacking device comprising:

a transport device with an upper side for transporting the sheet elements, the upper side having a plurality of sheet sections configured to receive sheet elements to be arranged thereon, the plurality of sheet sections being arranged in rows and columns, wherein rows are aligned in a transport direction of the stacking device, and columns perpendicular thereto in a stacking direction, and wherein the plurality of sheet sections of one column comprise at least one first sheet section and at least one adjacent second sheet section arranged further downstream in the stacking direction, and wherein a height offset is provided in the stacking direction between the first sheet section and the second sheet section, said height offset allowing at least one sheet element on the first sheet section to be moved over and be positioned on top of an adjacent sheet element on the second sheet section, at least one displacement element driven to be moved transverse to the transport direction along the sheet sections of a column, the displacement element engaging with the sheet sections of one column for shifting the at least one sheet element of a first sheet section onto the sheet element on the adjacent second sheet section, and wherein a guide for the displacement elements is arranged above the sheet sections, the guide extending obliquely across the upper side of the transport device in the transport direction.

2. The stacking device according to claim 1, wherein stop protrusions defining front ends of the sheet sections are provided, more preferably wherein the stop protrusions of one column are provided in a linear arrangement.

3. The stacking device according to claim 1, wherein the sheet sections are sloped in the stacking direction.

4. The stacking device according to claim 3, wherein the sheet sections are upwardly sloped in the stacking direction.

5. The stacking device according to claim 1, wherein said at least one displacement element is associated to each column.

6. The stacking device according to claim 1, wherein the guide forms part of an endless loop track.

7. The stacking device according to claim 1, wherein the displacement elements extend to a position below the sheet sections.

8. The stacking device according to claim 7, wherein the sheet sections comprise at least one lateral groove into which the displacement element protrudes, in particular wherein the lateral groove extends perpendicular to the transport direction.

9. The stacking device according to claim 8, wherein at least two displacement elements are provided for each column, each of the displacement elements having an associated single groove in the sheet sections of a column.

10. The stacking device according to claim 9, wherein the displacement elements of each column are affixed to a common carrier guided by the guide.

11. The stacking device according to claim 1, wherein a transport velocity of the sheet section in transport direction corresponds to the velocity of the displacement element in transport direction.

12. The stacking device according to claim 1, wherein the transport device is formed as an endless track, in particular wherein the endless track comprises an endless belt, and/or wherein profiled transport blocks defining the upper side being attached to each other, in particular by an endless pull or push element or are attached to each other to define an endless chain.

13. The stacking device according to claim 12, wherein the transport block has a profiled upper side and an opposite lower side, the upper side having a plurality of sheet sections configured to receive sheet elements to be arranged thereon, and wherein said height offset is provided in the stacking direction between adjacent sheet sections.

14. The stacking device according to claim 13, wherein the transport block has a front and a rear end the front end comprising a stop protrusion protruding above the sheet sections and/or wherein the transport block has at least one groove at its upper side extending parallel to the front end.

* * * * *